United States Patent [19]

Filmer

[11] Patent Number: 4,641,442

[45] Date of Patent: Feb. 10, 1987

[54] DISPLAY UNITS

[75] Inventor: Alan M. Filmer, Auckland, New Zealand

[73] Assignee: Development Finance Corporation of New Zealand, Limited, Auckland, New Zealand

[21] Appl. No.: 743,919

[22] Filed: Jun. 12, 1985

[51] Int. Cl.[4] ..... G09F 13/12

[52] U.S. Cl. ..... 40/219

[58] Field of Search ..... 40/219, 577, 152.2; 272/8 M

[56] References Cited

U.S. PATENT DOCUMENTS

| | | | |
|---|---|---|---|
| 1,683,263 | 9/1928 | Ruckelshaus | 40/463 |
| 2,200,021 | 5/1940 | Clark | 368/256 |
| 2,588,545 | 3/1952 | Lawrence | 40/152.2 |
| 2,745,678 | 5/1956 | Morgan | 280/152 R |
| 4,139,955 | 2/1979 | Reiback | 40/427 |
| 4,279,088 | 7/1981 | Hyre | 40/442 |
| 4,380,880 | 4/1983 | Gandy | 40/152.2 |
| 4,388,130 | 6/1983 | Bautze | 40/159 |

FOREIGN PATENT DOCUMENTS

| | | | |
|---|---|---|---|
| 28350 | of 1913 | United Kingdom | 40/219 |
| 527266 | 10/1940 | United Kingdom | 40/219 |

*Primary Examiner*—Gene Mancene
*Assistant Examiner*—Cary E. Stone
*Attorney, Agent, or Firm*—Holman & Stern

[57] ABSTRACT

A display unit for displaying indicia such as advertising material has a light box in which there are a series of lights. The box has a reflective surface capable of passing light outwardly from inside the box but reflecting light applied exteriorly of the surface. Indicia are mounted within the box carrying translucent and washed areas. Lighting of the lights displays the indicia and extinguishing the lights results in a mirrored surface only being apparent.

Modification include making the masked areas of a reflective material to give a repeated reflection effect when the lights are lit.

5 Claims, 3 Drawing Figures

FIG.1
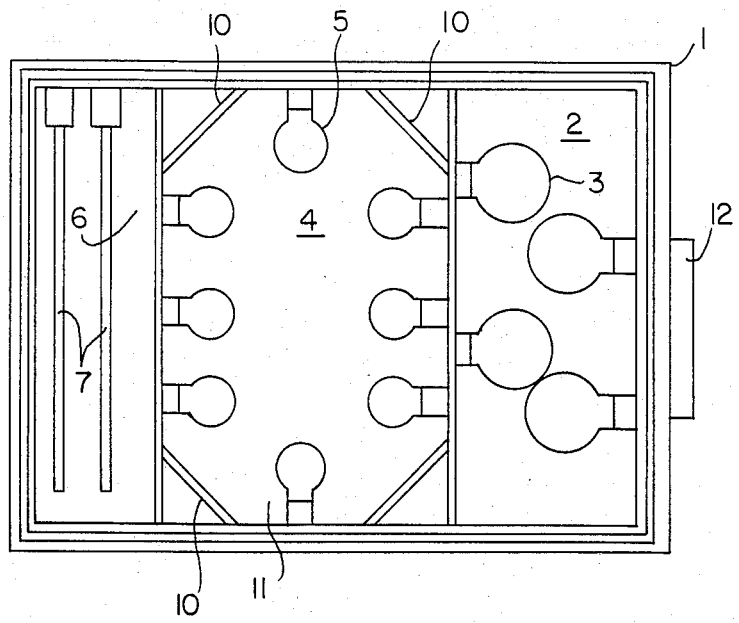
FIG.3
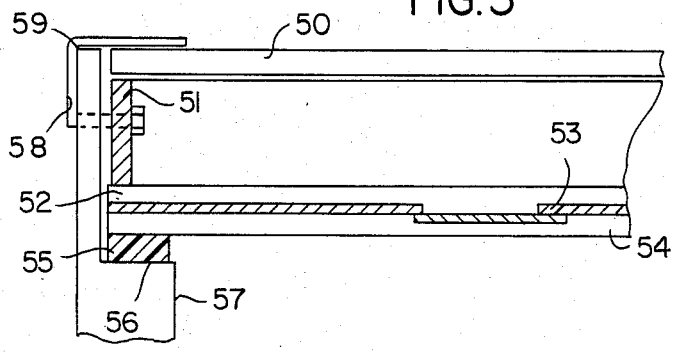
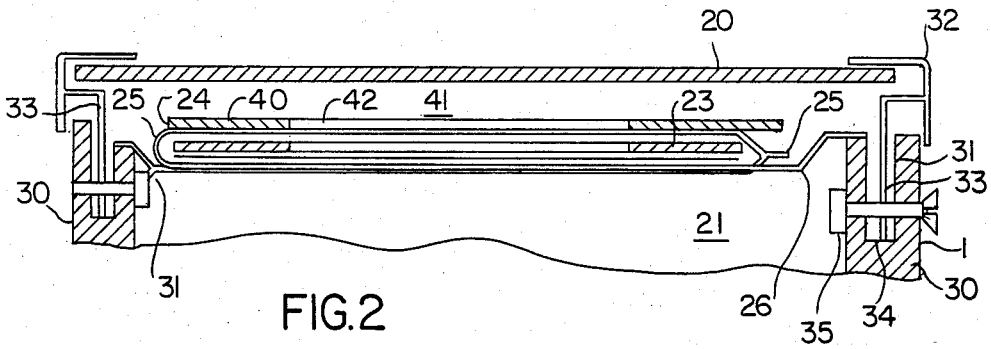
FIG.2

DISPLAY UNITS

This invention relates to display units.

It is an object of the present invention to provide a display unit which will at least provide the public with a useful choice.

Accordingly the invention consists in a display unit comprising a light box containing a series of light units, one surface of said light box comprising a sheet of material which in use will transmit light from the interior of the light box outwardly, but which will reflect light directed towards the sheet of material from exterior of the light box, indicia bearing means including translucent and masked areas mounted within the light box, the construction and arrangement being such that on the light sources within said light box being illuminated, said indicia will be displayed through said sheet of material and when said light box is not illuminated, said sheet of material will act as a mirror uncluttered by the indicia.

This invention may also broadly be said to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

One preferred form of the invention will now be described with reference to the accompanying drawings in which:

FIG. 1 is a plan view of a display unit according to the invention with the sheet material removed therefrom;

FIG. 2 is a cross section of the sheet material a transparency and edges of the box, and FIG. 3 is of a cross section of a further embodiment of the invention.

Referring to FIGS. 1 and 2 of the drawings a display unit according to the invention has a light box 1 and the light box contains a plurality of light sources, for example, in a first compartment 2 a series of incandescent lamps 3, in the second compartment 4 a further series of different type of incandescent lamps 5 and in a third compartment 6 a series of fluorescent lamps 7. One or more of the compartments may be provided with mirrors, for example, the mirrors 10 and the base of the compartment 11 may also be mirrored. At one end of the light box is a fan 12 arranged to supply a current of air through the compartments of the light box to cool the interior of the light box. If necessary air exits may also be provided or air ducting used and preferably such air exits or ductings are arranged so as to be light tight.

Referring now to FIG. 2, mounted on one surface of the light box is a sheet material 20 and that sheet material is such that light will be transmitted from the interior 21 of the light box but light from the ambient surroundings outside the light box will be reflected from the sheet material so that the sheet material acts as a mirror. Preferably that sheet material comprises grey MIRROPANE as manufactured by Libby-Owens Ford of the United States of America. It is a surface coated e.g. chromium coated glass which has the attributes desirable for this invention.

Mounted within the light box are indicia displaying means which preferably comprise a photographic transparency such that when light is transmitted therethrough the indicia will be illuminated. This transparency 23 is preferably mounted in a transparent envelope 24 and the edges 25 of the envelope are substantially but preferably completely sealed. Thus the envelope 24 is preferably a transparent plastics material and the sealing may be heat sealing or by an adhesive or combination of both. This envelope results in the transparencies being kept clean and otherwise protected during handling thereof. The transparencies 23 are masked by a mask or masks 26 so that only in the area where there is a transparency will light be transmitted from inside the light box through the sheet material 20.

The walls 30 of the light box are grooved as at 31 and frame members 32 are provided comprising angle members having intermediate flanges 33. The flanges 33 of the surround fit within the grooves 31 and are held therein by screws 34 engaging fixed nuts e.g. hank nuts 35 arranged internally of the light box and the screws 34 preferably having an allen headed socket therein which can be turned with an allen key so that the screws can be readily removed and the surround and sheet material 20 removed for replacing transparencies, replacing light sources and for other purposes.

Preferably a reflecting mask 40 is positioned in the space 41 between the transparency 23 and the sheet material 20 and disposed to reflect light received from the reflective surface of sheet material 20 back towards that sheet material. The reflective surface coating of sheet material 20 is positioned or that surface of the sheet material which is one face of the space 41. The reflective mask 40 has transparent portions or cut outs 42 the outline of which coincide with those parts of the transparency through which light from the light sources 3, 5 and/or 7 is to be transmitted. The reflective mask 40 may be in addition or as an alternative to mask 26. The distance of mask 40 from sheet material 20 is variable as between one display unit and another and may be made adjustable in any particular unit e.g. by making the flanges 33 or the flanges 33 and grooves 31 telescopic.

The use of the display unit is as follows.

With a transparency in position and the lights switched on light passes through the transparency through the transparent portion of mask 40 and through the sheet material 20 to be seen from outside, some of the transmitted light is reflected back from the inner surface of sheet material 20 on to the reflective surface of mask 40 and some of this reflective light passes outwardly through to mask 40 and this partial transmission and partial reflection is repeated within limits. The result is that multiple images of the transparency are seen by a viewer giving an augmented display effect.

Thus, referring to FIG. 3, which illustrates a further embodiment of the invention, a grey Mirropane sheet 50, silvered side down is separated by a surround 51 from an etched mirror 5 arranged with the silvered side down. The mirror 52 has a transmittable image medium 53 in non mirrored parts of it. A clear backing 54 is provided and thus backing is mounted on a resilient e.g. rubber pad 55 resting in a rebate 56 in the wall 57.

The surround 51 is a loose frame and is readily provided in various depths as desired.

A series of screws 58 hold the surround 51, the mirror 52 and the backing 54 in place and the pad 55 is preferably compressed by the surround 51 when the screws are in place. A simple angle edging 59 is provided to hold its mirropane 50 in place.

The light sources may be switched to give a satisfactory on/off pattern so that parts of the indica can be lit up in sequence or together to give a satisfactory display depending on the requirements of the user. The rate of switching may be manually variable.

Additionally, if desired, a clock is provided displaying indicia, for example, by liquid crystal display or L.E.D. and preferably this clock is programmed so that the display will show the date during one cycle of sequence and the time during a succeeding cycle of sequence. These cycles being alternated at a suitable time interval or by manual control as required.

In place of the MIRROPANE, a half silvered mirror or one having less than the usual thickness of mirror coating thereon is provided preferably backed by a clear lacquer for protection.

At least some of and preferably all of the light sources may be fluorescent lights and these may be controlled by shutters which are electronically controlled. Thus a fluorescent tube may pass through a dividing wall and light from it on one side of the wall may be controlled by such a shutter.

From the foregoing it will be seen that a display unit is provided which at least in the preferred form has the advantage that when the light sources are not energized the display unit has the appearance of a mirror or a tinted or darkened glass effect but when the light sources are energized, areas of the sheet material will be illuminated with a display giving, for example, an advertising message or some other form of communication of information, the display unit accordingly comprising a communication medium.

What is claimed is:

1. A display unit comprising a light box containing a series of light units, one surface of said light box comprising a sheet of material which in use will transmit light from the interior of the light box outwardly, but which gives a darkened glass effect when light is directed towards the sheet of material from exterior of the light box, indicia bearing means including translucent and masked areas mounted within the light box, the construction and arrangement being such that on the light source within said light box being illuminated, said indicia will be displayed through said sheet of material and when said light box is not illuminated, said sheet of material will give a darkened glass effect wherein said masked areas have a reflective surface and said sheet material has a reflective surface both said reflective surfaces defining walls of a space between them, giving a multi image view of indicia when illuminated.

2. A display unit as claimed in claim 1 wherein said light box is divided into compartments, each compartment having a different light source therein.

3. A display unit as claimed in claim 1 wherein said translucent areas comprise sheets of a transparent substantially sealed envelope.

4. A display unit as claimed in claim 3 wherein the translucent areas of said indicia bearing means comprise a photographic transparency.

5. A display unit as claimed in claim 1 wherein said light box is provided with a groove in the sides and ends thereof adjacent the surface to which said sheet material is fixed and a surround is provided comprising an angle member with a further flange, the further flange fitting in the groove in the light box and being held therein by screws or other fasteners, said sheet of material and said indicia bearing means being held in position by said surround.

* * * * *